US008479827B2

(12) United States Patent
Davis

(10) Patent No.: US 8,479,827 B2
(45) Date of Patent: Jul. 9, 2013

(54) DISCONNECT DEVICES FOR DOWNHOLE STRINGS

(75) Inventor: John P. Davis, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 381 days.

(21) Appl. No.: 12/931,453

(22) Filed: Jan. 31, 2011

(65) Prior Publication Data

US 2012/0193105 A1 Aug. 2, 2012

(51) Int. Cl.
*E21B 19/16* (2006.01)
*E21B 23/00* (2006.01)
*E21B 17/00* (2006.01)

(52) U.S. Cl.
CPC ..... *E21B 19/16* (2013.01)
USPC ..... 166/377; 166/383; 166/242.6

(58) Field of Classification Search
USPC ..... 166/377, 383, 242.6
See application file for complete search history.

(56) References Cited

U.S. PATENT DOCUMENTS 3,753,471 A 8/1973 Kammerer, Jr. et al.
3,842,914 A 10/1974 Mott
3,867,985 A * 2/1975 Wilkinson ..... 166/329
4,099,563 A 7/1978 Hutchison et al.
4,175,778 A 11/1979 Nunez et al.
4,273,186 A * 6/1981 Pearce et al. ..... 166/72
4,364,587 A 12/1982 Samford
4,445,572 A * 5/1984 Fineberg et al. ..... 166/188
4,452,472 A 6/1984 Crase
4,531,766 A 7/1985 Crase
4,601,492 A 7/1986 George
4,915,423 A 4/1990 Wallace
4,984,632 A 1/1991 Sampa et al.
5,050,691 A 9/1991 Moses
5,086,843 A 2/1992 Mims et al.
5,219,027 A 6/1993 Taylor
5,323,853 A 6/1994 Leismer et al.
5,419,399 A 5/1995 Smith
5,476,392 A 12/1995 Inaba et al.

(Continued)

OTHER PUBLICATIONS

Notification of Transmittal of the International Search Report and the Written Opinion of the International Searching Authority, or the Declaration, Jul. 25, 2012, pp. 1-2, PCT/US2011/065829, Korean Intellectual Property Office.

(Continued)

*Primary Examiner* — Cathleen Hutchins
(74) *Attorney, Agent, or Firm* — Greenberg Traurig LLP; Anthony F. Matheny

(57) ABSTRACT

A disconnect device comprises a tubular member having a window for receiving an engagement member, and a sleeve having connected and disconnected positions. The engagement member engages with a component of a downhole string to connect the disconnect device to the rest of the string such as through a helically-shaped thread disposed on the engagement member and on the component. The window can comprise at least one wall that is outwardly tapered so as to prevent the engagement member from passing through the window when the tubular member is disconnected from the component of the string. The engagement member is maintained within the window by the sleeve when in its connected position to maintain the connection between the tubular member and the component. When moved to its disconnected position, the engagement member disengages the component by moving inwardly into the bore of the tubular member.

18 Claims, 3 Drawing Sheets

U.S. PATENT DOCUMENTS

| | | | | |
|---|---|---|---|---|
| 5,526,888 | A | 6/1996 | Gazewood | |
| 5,787,928 | A | 8/1998 | Allen et al. | |
| 5,984,029 | A | 11/1999 | Griffin et al. | |
| 6,318,470 | B1 * | 11/2001 | Chang et al. | 166/377 |
| 7,395,862 | B2 | 7/2008 | Ross et al. | |
| 2004/0216887 | A1 | 11/2004 | Bertelsen | |
| 2005/0103501 | A1 | 5/2005 | Howlett | |
| 2008/0099210 | A1 | 5/2008 | Gazewood | |

OTHER PUBLICATIONS

International Search Report, Jul. 25, 2012, pp. 1-3, PCT/US2011/065829, Korean Intellectual Property Office.

Written Opinion of the International Searching Authority, Jul. 25, 2012, pp. 1-4, PCT/US2011/065829, Korean Intellectual Property Office.

* cited by examiner

DISCONNECT DEVICES FOR DOWNHOLE STRINGS

BACKGROUND

1. Field of Invention

The invention is directed to disconnect devices for downhole strings and, in particular, disconnect devices that permit disconnection of one part of a string from another part of a string in oil and gas exploration and production operations.

2. Description of Art

In the drilling, completion, and workover of oil and gas wells, it is common to perform multiple operations downhole in the wellbore. It is also common for one portion of a tool string having multiple tools to be run-in to the wellbore where a downhole operation is performed that results in a part of the tool string being left within the wellbore so the tool string can be retrieve or moved to another location within the wellbore where additional operations can be performed. To permit such movement of the tool string, the part of the tool string to remain in a certain location must be disconnected from the rest of the tool string.

Alternatively, one part of a string could become stuck within a well necessitating the disconnection and retrieval of the other part of the string. Disconnection from the stuck portion of the string is facilitated using a disconnect device.

Further, during run-in of a casing string a problem could arise where the shear rams of a blowout preventer could not shear the casing string. Disconnection from the casing string above the blowout preventer would allow the casing string to fall through the blowout preventer allowing the shear rams to close-off the well.

SUMMARY OF INVENTION

Broadly, the invention is directed to disconnect devices used to separate one part of a tool or work string from another part of the tool or work string. The disconnect device includes a tubular member having an inner wall surface, outer wall surface, and a window. Disposed within the window is an engagement member, such as a torque block, that is used to engage with another tool or another part of the tool or work string. The engagement member is held in place by a sleeve disposed on the inner wall surface of the tubular member. The sleeve prevents the engagement member from backing out of the window and prematurely releasing the tubular member from the rest of the tool or work string. The sleeve includes a restraining member that holds the sleeve in place during run-in and during operation of the tool or work string prior to disconnecting the disconnect device from the tool or work string. In one embodiment, the restraining member is a c-ring. The sleeve further includes an actuator such as a seat for receiving a plug member to facilitate movement of the sleeve during disconnect operations.

After the tool or work string is run-in to depth in the wellbore and it is desired to disconnect one portion of the tool or work string from another portion of the tool or work string, a plug member, such as a ball, is dropped down the tool or work string and landed on the seat. Pressure is then increased above the seat such as by pumping fluid down the tool or work string. Upon the pressure above the seat reaching a certain pressure, the sleeve is released by the restraining member and slides downward within the tubular member. Upon moving a certain distance, the engagement member is no longer held in place by the sleeve. As a result, the engagement member disengages the rest of the tool or work string and moves inwardly, thereby releasing the disconnect device, and the portion of the string located above the disconnect device, from the portion of the tool or work string that will remain in place within the wellbore.

While the invention will be described in connection with the preferred embodiments, it will be understood that it is not intended to limit the invention to these embodiments. On the contrary, it is intended to cover all alternatives, modifications, and equivalents, as may be included within the spirit and scope of the invention as defined by the appended claims.

DETAILED DESCRIPTION OF INVENTION

Figure 4:
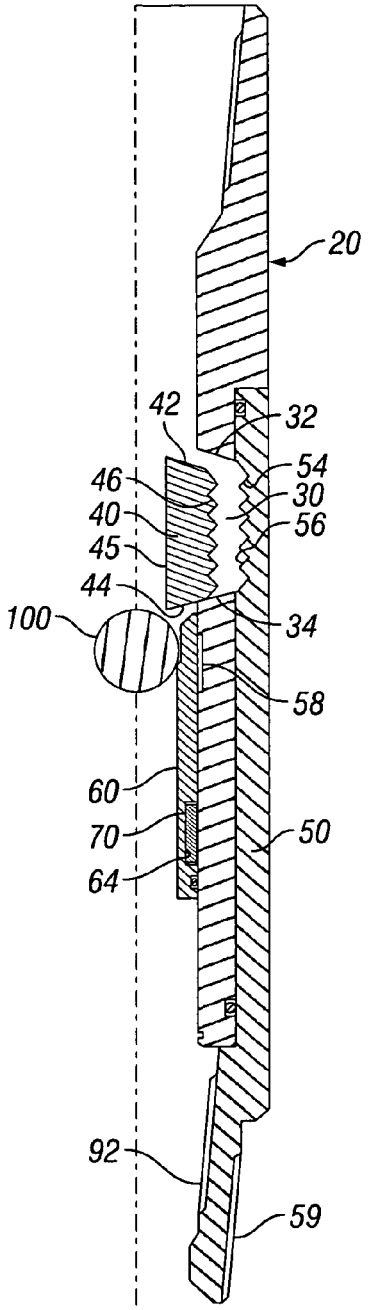
FIG. 4 is a cross-sectional view of the disconnect device and component of FIG. 1 after the sleeve has moved to release the engagement member to disconnect the disconnect device from the component of the tool or work string so that the disconnect device and any additional components of the tool or work string disposed above the disconnect device can be moved upward within the wellbore.

Referring now to FIGS. 1-4, disconnect device 10 comprises tubular member 20 having upper end 21, lower end 22, outer wall surface 24, and inner wall surface 26 defining bore 28. Window 30 having upper wall 32 and lower wall 34 is disposed through outer wall surface 24. Upper wall 32 and lower wall 34 of window 30 are best shown in FIG. 4. Although window 30 can have any shape for receiving engagement member 40 (discussed in greater detail below), as shown in FIGS. 1-4, upper wall 32 and lower wall 34 of window 30 are tapered outwardly, i.e., the opening of window 30 is larger on inner wall surface 26 as compared to the opening on outer wall surface 24. In another specific embodiment, window 30 can be conically shaped with a single outwardly tapered wall providing a circularly opening, i.e., the circular opening on inner wall surface 26 has a larger diameter than the diameter of the circular opening on outer wall surface 24.

Disposed at upper end 21 of tubular member 20 is attachment member 90. Attachment member 90 facilitates securing disconnect device 10 to another component of a tool or work string disposed above disconnect device 10. Attachment member 90 may be threads or any other attachment member known in the art. In addition, although attachment member 90 is shown in the embodiment of FIGS. 1-4 as being disposed on inner wall surface 26 of tubular member 20, it is to be understood that attachment member 90 may be disposed on outer wall surface 24 of tubular member 20.

Disconnect device 10 is initially secured to component 50 of the tool or work string which is disposed below disconnect device 10. Disconnect device 10 is initially secured to string component 50 at the surface of the wellbore before being run-in the wellbore. String component 50 comprises upper end 51, lower end 52, engagement profile 54 disposed on inner wall surface 56, shoulder 57 disposed on inner wall surface 56, and attachment member 59, such as threads, disposed on outer wall surface 55 of component 50 for securing component 50 to another component of the tool or work string.

In making up the connection between disconnect device 10 and component 50, shoulder 29 of tubular member 20 engages upper end 51 of component 50, lower end 22 of disconnect device 10 engages shoulder 57 of component 50, and disconnect device 10 is releasably secured to component 50 by engagement member 40.

Engagement member 40 comprises upper wall 42, lower wall 44, inner wall surface 45, and engagement profile 46. Although engagement member 40 can have any shape for being received within window 30, in the specific embodiment of FIGS. 1-4, upper wall 42 and lower wall 44 of engagement member 40 are tapered outwardly. In another specific embodiment, engagement member 40 can be conically shaped with a single tapered wall providing a circularly-shaped engagement profile 46.

Engagement profile 46 engages with engagement profile 54 disposed on inner wall surface 56 of component 50. In the embodiment shown in FIGS. 1-4, engagement profile 46 is reciprocal to engagement profile 54. Further, the embodiment of FIGS. 1-4, engagement profile 46 and engagement profile 54 comprises reciprocal helically-shaped threads having a taper of in the range of approximately 30 degrees to approximately 60 degrees. In one specific embodiment, engagement member 40 comprises torque and releasing blocks having engagement profiles 46, 54 comprising helically-shaped threads such that rotation of disconnect device 10 causes the threads to engage one another. Engagement of engagement member 40 with component 50 causes engagement member 40 to be biased inwardly such that engagement member 40 is energized to move inwardly through window 30 and into bore 28.

Figure 1:
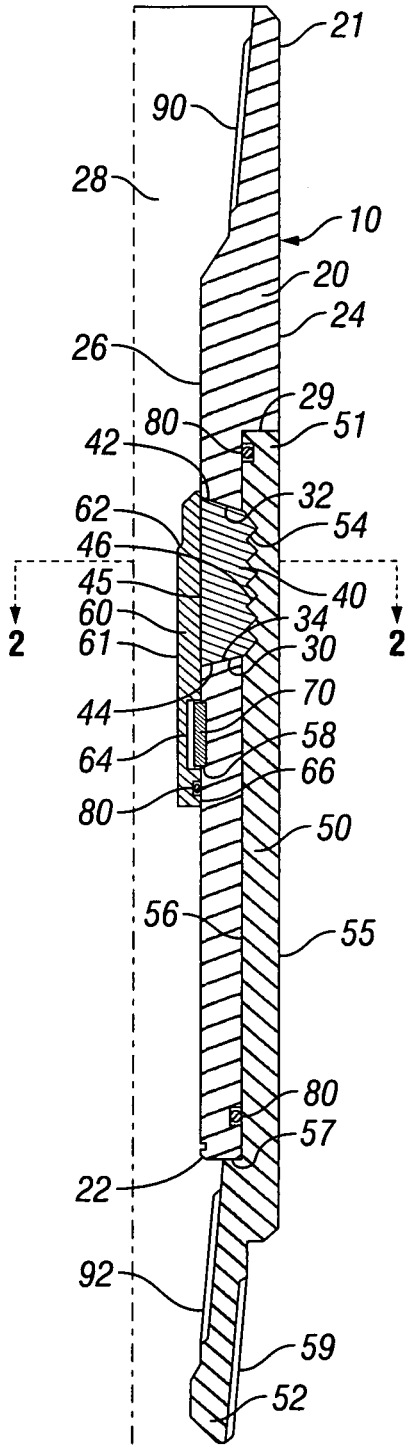
FIG. 1 is a cross-sectional view of one specific embodiment of a disconnect device disclosed herein shown in its run-in position connected to a component of a tool or work string.
Figure 2:
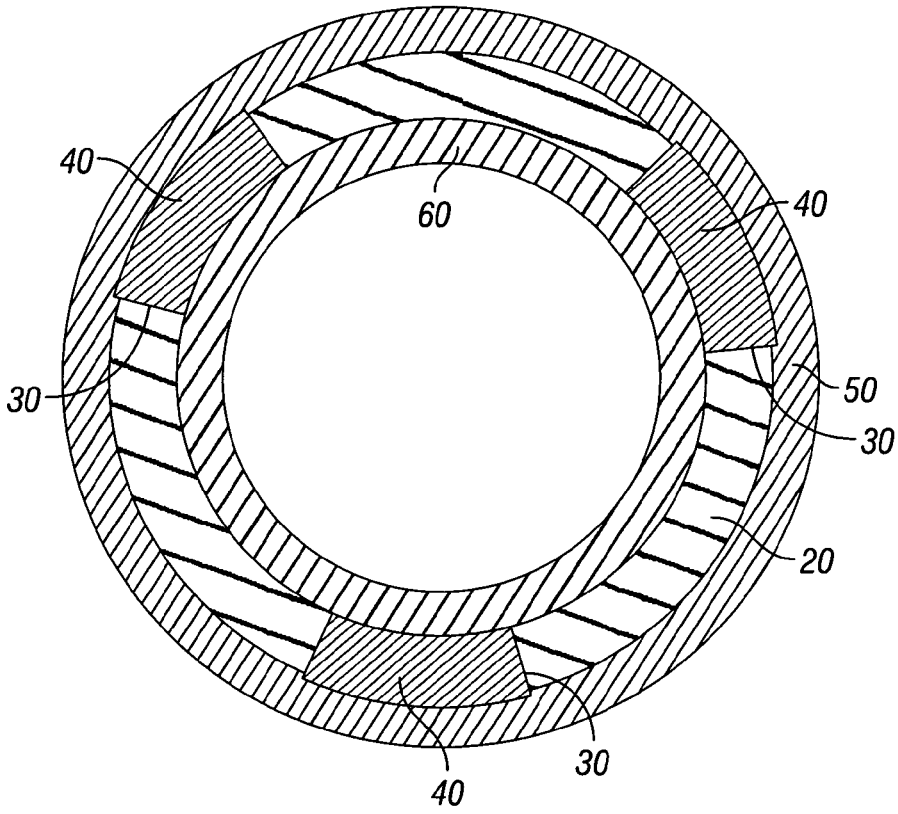
FIG. 2 is a cross-sectional view of the disconnect device and component of FIG. 1 taken along line 2-2.
Figure 3:
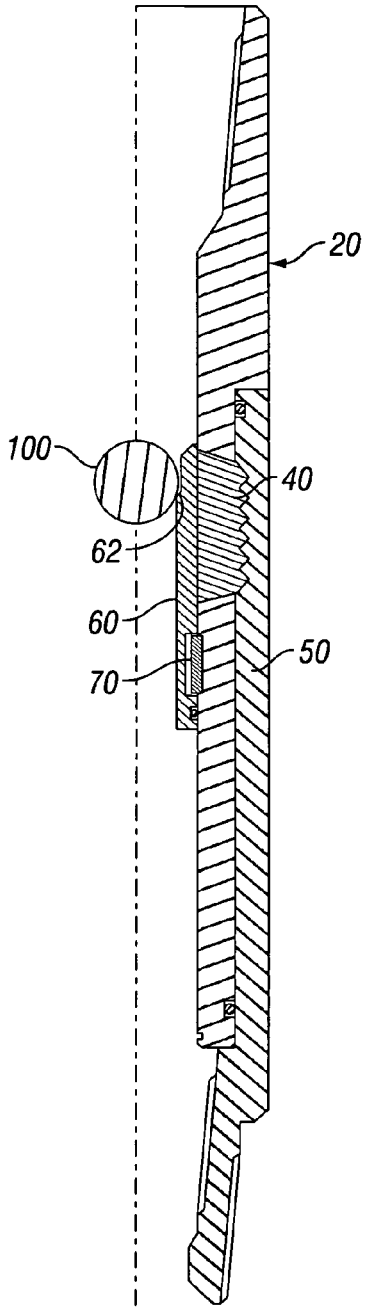
FIG. 3 is cross-sectional view of the disconnect device and component of FIG. 1 shown with a ball landed on the seat of the disconnect device.

As shown in FIG. 2, in the particular embodiment of FIGS. 1-4 tubular member 20 comprises three windows 30, each of which includes an engagement member 40 disposed therein for engaging with component 50.

Because engagement member 40 is biased inwardly, engagement member 40 is held within window 30 by sleeve 60 prior to actuation of disconnect device 10. Sleeve 60 is in sliding engagement with inner wall surface 26 of tubular member 20. Sleeve 60 comprises inner wall surface 61 having an actuation member shown in the embodiment of FIGS. 1-4 as seat 62. Sleeve is initially held in place by restraining member 70. In one specific embodiment, restraining member 70 comprises a c-ring disposed within recess 64 disposed on outer wall surface 66 of sleeve 60 when in the connected position shown in FIGS. 1-2, the c-ring is engaged with shoulder 58 disposed on inner wall surface 26 of tubular member 20. Shoulder 58 can be part of a recess or groove as shown in the Figures.

Disconnect device 10 and component 50 include seals 80 to prevent or reduce the likelihood of leakage between portions of disconnect device 10 and component 50.

In operation, disconnect device 10 is placed in a tool or work string above component(s) of the tool or work string that will be left within the wellbore while the remainder of the tool or work string, i.e., the disconnect device 10 and any components disposed above disconnect device 10, are released for upward movement within the wellbore. The tool or work string is then run-in to depth within the wellbore. When it is desired to disconnect part of the tool or work string below disconnect device 10, a plug member, shown as ball 100 in the embodiment of FIGS. 1-4, is dropped down the wellbore and landed on seat 62. Pressure is then built up above seat 62, such as by pumping fluid down the tool or work string. As a result of the increase in pressure above seat 62, restraining member 70 releases sleeve 60 and the increased pressure above seat 62 forces sleeve 60 to slide downwardly along inner wall surface 26 of tubular member 20. When sleeve 60 clears bottom wall 34 of window 30, engagement member 40 is permitted to disengage component 50 and move inwardly into bore 28 of tubular member 20. In so doing, component 50 is released or disconnected from the remainder of the tool or work string and disconnect device 10 and any other components of tool or work string disposed above disconnect device 10 can be moved upwardly within the wellbore.

In the embodiment in which upper and lower walls 32, 34 of window 30 and upper and lower walls 42, 44 of engagement member 40 are tapered outwardly as shown in the embodiment of FIGS. 1-4, engagement member 40 is unable to fall out of window 30. In addition, because ball 100 is landed on seat 62, if engagement member 40 falls into bore 28, it will land on top of ball 100 and will not be left within the wellbore.

So that component 50 can be retrieved, attachment member 92 is disposed on inner wall surface 56 of component 50. Attachment member 92 may comprise threads or any other attachment device. In one embodiment, attachment member 92 comprises threads so that a tool or work string having an outer diameter that is smaller than the inner diameter of component 50 can be run-in and secured to attachment member 92. Thereafter, the tool or work string can be moved upward to retrieve component 50.

It is to be understood that the invention is not limited to the exact details of construction, operation, exact materials, or embodiments shown and described, as modifications and equivalents will be apparent to one skilled in the art. For example, although ball 100 is disposed on seat 62, it is to be understood that the seat is not required to be a ball seat and the plug element is not required to a ball. Instead, the seat can have any other shape desired or necessary for receiving a reciprocally shaped plug element. Further, the actuator is not required to be a seat/plug member arrangement. Instead, the sleeve can include an attachment member, such as threads, into which a smaller diameter pipe is attached to push the sleeve downward. Alternatively, the sleeve could be pushed downward from above using any device, with or without being attached to the sleeve before it is moved. Moreover, to the extent that the terms well or wellbore are argued to be limiting in their definition, it is to be understood that these terms should not be limited and these terms as used herein include, but are not limited to, cased wellbores, open-hole wellbores cut into a formation, and boreholes. These terms also refer to locations where part of the string may be disposed within the earthen part of the well while the disconnect devices may be disposed above a blowout preventer operatively associated with the well, such as during underwater exploration and production where the well includes a riser with a blowout preventer disposed on the seabed. Accordingly, the invention is therefore to be limited only by the scope of the appended claims.

What is claimed is:

1. A disconnect device for releasing a component of a downhole string, the disconnect device comprising:

a tubular member having an upper end, a lower end, an outer wall surface, an inner wall surface defining a bore, and a window disposed through the outer wall surface and in fluid communication with the bore;

an engagement member disposed within the window, the window comprising at least one outwardly tapered wall and the engagement member comprising an engagement profile for engaging a component of a downhole string, the engagement profile including a helically-shaped thread; and a sleeve in sliding engagement with an inner wall surface of the tubular member, the sleeve comprising an actuator, a connected position, and a disconnected position, wherein actuation of the actuator causes the sleeve to move from the connected position to the disconnected position causing the engagement member to disengage from the component of the downhole string.

2. The disconnect device of claim 1, further comprising a restraining member operatively associated with the sleeve, the restraining member comprising a c-ring disposed in recess on the outer wall surface of sleeve.

3. The disconnect device of claim 2, wherein the inner wall surface of the tubular member comprises a recess for receiving the c-ring when the sleeve is in the connected position.

4. The disconnect device of claim 1, wherein the window comprises two outwardly tapered walls.

5. The disconnect device of claim 1, wherein the at least one outwardly tapered wall comprises a conical shape.

6. The disconnect device of claim 1, wherein the actuator comprises a seat for receiving a plug member, wherein landing the plug member on the seat causes pressure to build up above the seat thereby moving the sleeve from the connected position to the disconnected position.

7. The disconnect device of claim 6, wherein the seat comprises a ball seat and the plug member comprises a ball.

8. The disconnect device of claim 1, further comprising at least three windows, each of the at least three windows having disposed therein an engagement member.

9. A downhole string comprising:

a first string component releasably connected to a disconnect device, the disconnect device comprising a tubular member having an upper end, a lower end, an outer wall surface, an inner wall surface defining a bore, and a window disposed through the outer wall surface and in fluid communication with the bore, an engagement member disposed within the window, the engagement member comprising an engagement profile for engaging a component of a downhole string, and a sleeve in sliding engagement with an inner wall surface of the tubular member, the sleeve comprising an actuator, a connected position, and a disconnected position, wherein actuation of the actuator causes the sleeve to move from the connected position to the disconnected position causing the engagement member to disengage from the first string component of the downhole string, wherein the first string component comprises a component engagement profile disposed on an inner wall surface of the first string component, the component engagement profile being reciprocal in shape to the engagement profile, and wherein the engagement profile and the component engagement profile each comprise a helically-shaped thread.

10. The downhole string of claim 9, wherein the first string component comprises an attachment member disposed at a lower end on an inner wall surface of the first string component.

11. The downhole string of claim 9, wherein the window comprises at least one wall that is tapered outwardly to prevent the engagement member from passing outwardly through the window.

12. The downhole string of claim 11, wherein the at least one wall comprises a conical shape that is tapered outwardly.

13. The downhole string of claim 9, wherein the window comprises two walls that are tapered outwardly to prevent the engagement member from passing outwardly through the window.

14. A method of disconnecting an upper portion of a downhole string from a lower portion of a downhole string, the method comprising the steps of:

(a) providing a downhole string comprising an upper portion and a lower portion, the upper portion being releasably connected to the lower portion by a disconnect device, the disconnect device comprising a tubular member having an upper end, a lower end, an outer wall surface, an inner wall surface defining a bore, and a window disposed through the outer wall surface and in fluid communication with the bore, an engagement member disposed within the window, the engagement member comprising an engagement profile for engaging a component of a downhole string, the engagement profile including a helically-shaped thread, and a sleeve in sliding engagement with an inner wall surface of the tubular member, the sleeve comprising an actuator, a connected position, and a disconnected position, wherein actuation of the actuator causes the sleeve to move from the connected position to the disconnected position causing the engagement member to disengage from the lower portion of the downhole string;

(b) running the downhole string into a well;

(c) actuating the disconnect device from the connected position to the disconnected position by moving the sleeve causing the engagement member to move inwardly and disengage the lower portion of the string; and (d) moving the upper portion of the downhole string upward leaving the lower portion of the string in the well.

15. The method of claim 14, further comprising the steps of (e) after step (d), running a retrieval tool in the wellbore, the retrieval tool having a first attachment member disposed at a lower end of the retrieval tool;

(f) engaging the first attachment member with a second attachment member disposed at a lower end of an inner wall surface of the lower portion of the string; and (g) withdrawing the lower portion of the string from the wellbore with the retrieval tool.

16. The method of claim 14, wherein the engagement member is moved inwardly during step (c) due to the window comprising at least one outwardly tapered wall that prevents the engagement member from passing outwardly through the window, the outwardly tapered wall guiding the engagement member inwardly.

17. The method of claim 14, wherein during step (c), the helically-shaped thread disposed on the engagement profile of the engagement member is disengaged from a reciprocally-shaped helically-shaped thread disposed on an inner wall surface of the lower portion of the downhole string.

18. The method of claim 14, further comprising the step of closing a blowout preventer operatively associated with the well after of step (d).

* * * * *